United States Patent [19]

Forrester

[11] Patent Number: 4,913,318

[45] Date of Patent: Apr. 3, 1990

[54] PORTABLE BEVERAGE DISPENSER

[76] Inventor: Thomas L. Forrester, 74 Spar Ct., Pleasant Hill, Calif. 94523

[21] Appl. No.: 243,825

[22] Filed: Sep. 13, 1988

[51] Int. Cl.[4] ..... B67D 5/62

[52] U.S. Cl. ..... 222/129; 222/146.1; 222/192; 222/608; 297/193; 224/42.42; 312/236

[58] Field of Search ..... 312/236; 222/129, 146.1, 222/146.2, 146.5, 146.6, 173, 192, 608, 609, 610; 297/193; 224/42.42 B; 137/353, 354

[56] References Cited

U.S. PATENT DOCUMENTS

| | | | |
|---|---|---|---|
| 3,111,166 | 11/1963 | Munz et al. | 312/236 X |
| 3,294,289 | 12/1966 | Bayne et al. | 222/95 |
| 3,560,047 | 2/1971 | Davis | 297/192 X |
| 4,027,727 | 6/1977 | Pullens | 312/236 X |
| 4,384,512 | 5/1983 | Keith | 222/146 R |
| 4,517,445 | 5/1985 | Tatsumi et al. | 222/209 X |

*Primary Examiner*—Kevin P. Shaver
*Assistant Examiner*—Edward S. Ammeen
*Attorney, Agent, or Firm*—Jerry T. Kearns

[57] ABSTRACT

A portable beverage dispenser houses a pair of plastic tanks divided by a partition, with each tank being able to heat or cool its contents. The housing also contains hand pumps for pressurizing the tanks, dispensing taps, and a padded lid which can be used as a seat. Heating tubes for each tank are attached to electrical heating elements, while independent tank cooling tubes are attached to thermoelectric cooling elements. The heating and cooling elements are independently connected to a rechargeable battery which is designed to operate under its own power, or connect to a conventional automatic cigarette lighter plug using a connecting wire with cigarette lighter plug members at each end. The beverage dispenser housing also houses radio speakers which are designed to plug into a small, portable radio which can be detached from the dispenser housing. Legs are attached within wells to guide tracks by guide runners. Retaining pins on the legs retractably protrude from the legs through holes in the housing to maintain the legs in either an extended or retracted position. A mounting skirt upon which the dispenser can be secured has side plates which are spring biased toward each other so as to hug a vehicle transmission hump. These side plates have small, sharp projections for gripping the vehicle carpet.

6 Claims, 5 Drawing Sheets

PORTABLE BEVERAGE DISPENSER

RELATED APPLICATIONS

This application is related to Ser. No. 06/883,047, Filed Jul. 8, 1986, abandoned.

BACKGROUND OF THE INVENTION

1. Field of the Invention

The present invention relates to portable beverage dispensers, and more particularly pertains to beverage dispensers for liquids which are heated or cooled using self-contained battery power or power from an outside source.

2. Description of the Prior Art

Various types of portable beverage dispensers are known in the prior art. Typical examples of such a portable beverage dispensers are to be found in U.S. Pat. Nos. 4,453,385, 4,384,512, 4,140,150, 3,955,713, 2,708,540, 2,661,015, and 2,812,227.

In particular, U.S. Pat. Nos. 4,384,512, 3,955,713, 2,708,540, and 2,661,015 show containers, adapted for use in automobiles, which either heat or cool liquids. U.S. Pat. Nos. 4,140,150 and 2,669,251 show liquid dispensers integrally mounted in automobiles. U.S. Pat. No. 2,812,227 shows a beverage container whose lid provides a padded seat.

While the above mentioned devices are suited for their intended usage, none of these devices provides heating and cooling of separate tanks capable of independently storing liquids using a self-contained power source. Nor do the above mentioned devices have built-in radio speakers and radio mounts which, in combination with the temperature regulated liquid storage, is useful either in an automobile or away from the car during a trip. Inasmuch as the art is relatively crowded with respect to these various types of portable beverage dispensers, it can be appreciated that there is a continuing need for and interest in improvements to such portable beverage dispensers, and in this respect, the present invention addresses this need and interest.

SUMMARY OF THE INVENTION

In view of the foregoing disadvantages inherent in the known types of portable beverage dispensers now present in the prior art, the present invention provides an improved portable beverage dispenser. As such, the general purpose of the present invention, which will be described subsequently in greater detail, is to provide a new and improved portable beverage dispenser which has all the advantages of the prior art portable beverage dispensers and none of the disadvantages.

To attain this, representative embodiments of the concepts of the present invention are illustrated in the drawings and make use of the separate containers for independently storing hot and cold liquids, of the radio mount and built in speakers, of the battery which is rechargeable using a jack which plugs into the cigarette lighter outlet of a car, of the transmission skirt mount to which the portable dispenser may be attached, and of the padded assembly lid for comfortable seating.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable beverage dispenser which has all the advantages of the prior art portable beverage dispensers and none of the disadvantages.

It is another object of the present invention to provide a new and improved portable beverage dispenser which may be easily and efficiently manufactured and marketed.

It is a further object of the present invention to provide a new and improved portable beverage dispenser which is of a durable and reliable construction.

An even further object of the present invention is to provide a new and improved portable beverage dispenser which is susceptible of a low cost of manufacture with regard to both materials and labor, and which accordingly is then susceptible of low prices of sale to the consuming public, thereby making such portable beverage dispensers economically available to the buying public.

Still yet another object of the present invention is to provide a new and improved portable beverage dispenser which provides in the apparatuses and methods of the prior art some of the advantages thereof, while simultaneously overcoming some of the disadvantages normally associated therewith.

Still another object of the present invention is to provide a new and improved portable beverage dispenser whose compactness and versatility make it especially useful either attached conveniently in an automobile using the car's battery or detached for portable use with a self-contained power source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
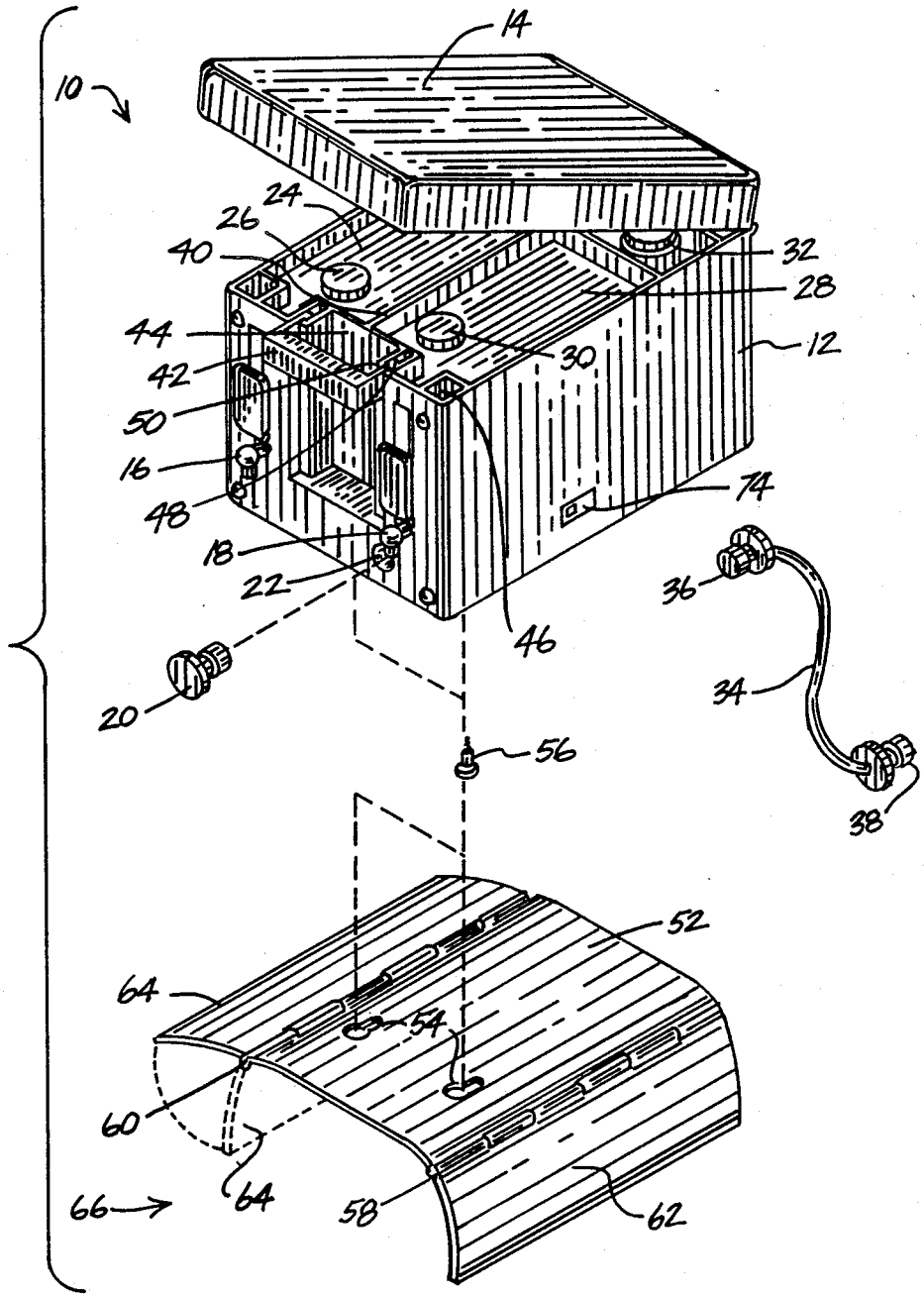
FIG. 1 is an exploded perspective view of the dispenser and mounting skirt.

With reference now to the drawings, and in particular to FIG. 1 thereof, a new and improved portable beverage dispenser embodying the principles and concepts of the present invention and generally designated by the reference numeral 10 will be described.

More specifically, it will be noted that the first embodiment 10 of the invention includes a beverage dispenser with housing 12 containing two tanks 24 and 28. Liquids stored within tanks 24 and 28 may be electrically heated or cooled. Tanks 24 and 28 are divided by insulated partition 40. Beverages are poured into the tanks through openings covered by removable lids 26 and 30. Dispenser hand pump 32 allows manual pressurization of tank 28. A similar hand pump exists for tank 24 as well. Dispensing taps 16 and 18 regulate the flow of liquids through an outlet from tanks 24 and 28, respectively. Switch 74 may be utilized to select cool, heat, or off positions for respectively actuating a cooling or heating element in tank 28, or to leave tank 28 at ambient temperature. Switch 76 shown in FIGS. 2 and 6 similarly controls the temperature of tank 24. Cigarette lighter 20 fits into lighter socket 22 for activation in a conventional manner.

The front wall of the housing contains a recess 44 large enough to receive a small radio. Handle 42 is connected to the housing by flange 48 which is retained by housing flange 50 in such a manner as to enable handle 42 to slide up and down along the housing front wall for the length of recess 44.

Figure 7:
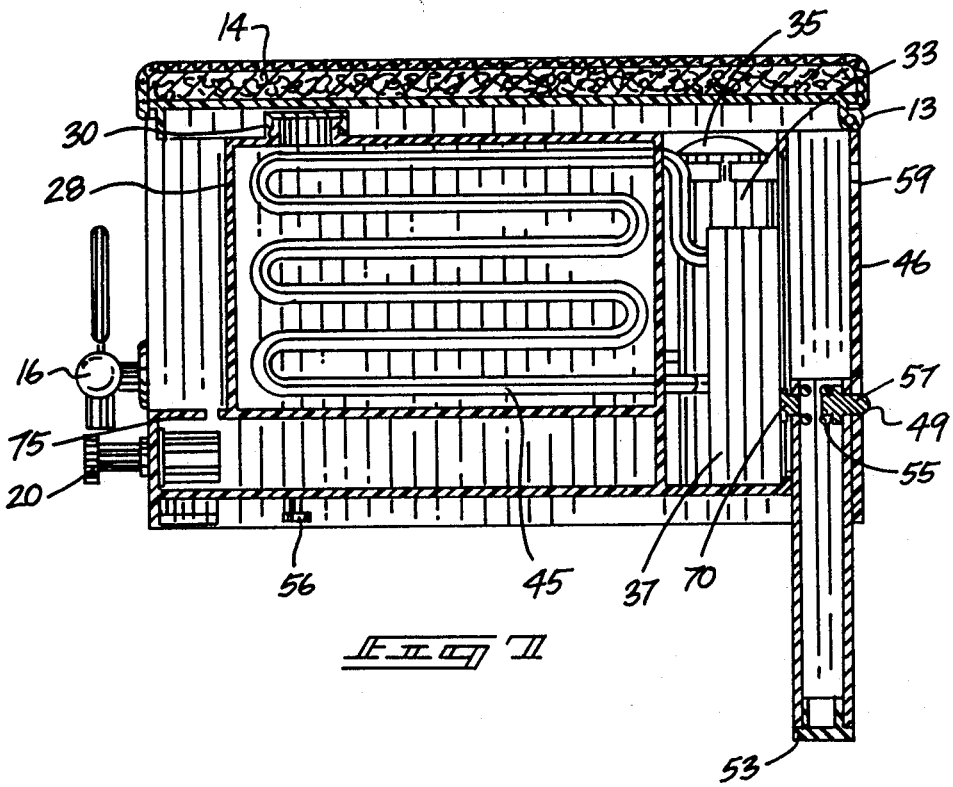
FIG. 7 is a side sectional view taken on line 7—7 of FIG. 2.
Figure 9:
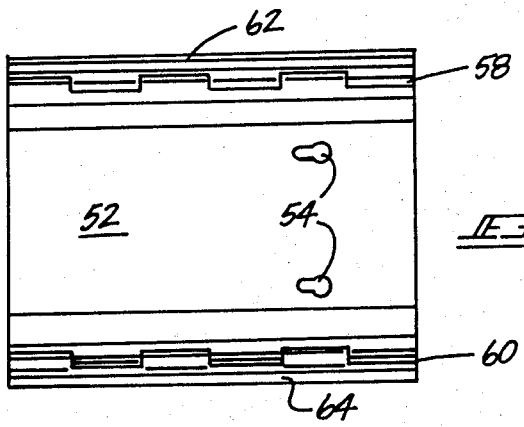
FIG. 9 is a top view of the mounting skirt.
Figure 10:
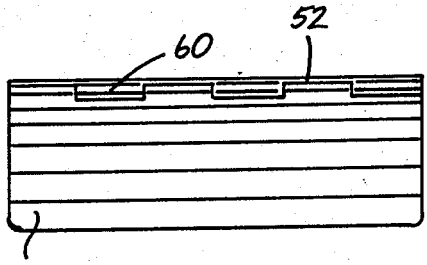
FIG. 10 is a side view of the mounting skirt.
Figure 11:
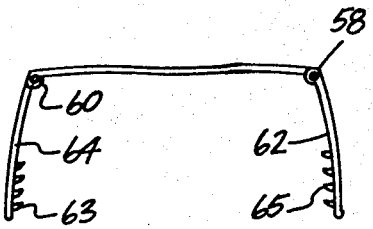
FIG. 11 is an end view of the mounting skirt.
Figure 8:
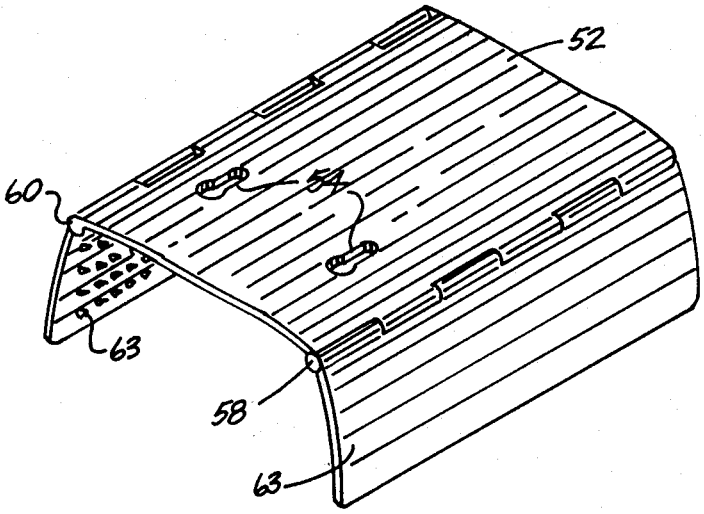
FIG. 8 is a perspective view of the mounting skirt.

A lid 14 hinged to the rear housing wall covers the dispenser. Lid 14 is padded for use as a seat when closed. Four corner leg wells 46 house extension legs 51 as shown in FIG. 7.

Returning to FIG. 1, mounting skirt 66 is comprised of a top plate 52 with key hole shaped eye holes 54 designed to releasably engage skirt mounting pegs 56 attached to the housing bottom of dispenser 10. Engaging pegs 56 within eye holes 54 mounts dispenser 10 onto mounting skirt 66. Side plates 62 and 64 are attached to top plate 52 by hinges 58 and 60, respectively. The hinges 58 and 60 are spring biased in a manner causing the side plates to close towards each other so as to hug the transmission hump of an automobile. For example, spring biased hinge 60 urges side plate 64 towards the position shown as 64'.

Figure 5:
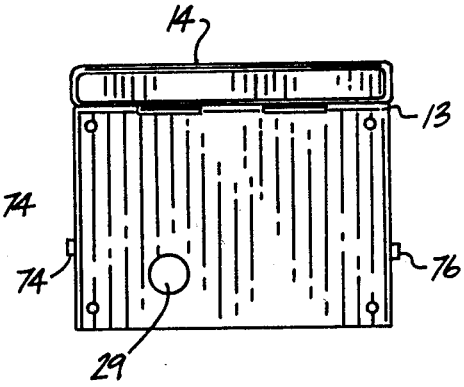
FIG. 5 is a rear elevation of the dispenser.

Connecting wire 34 has plug endings 36 and 38 for connection between an automobile lighter socket and dispenser socket 29, shown in FIG. 5.

Figure 2:
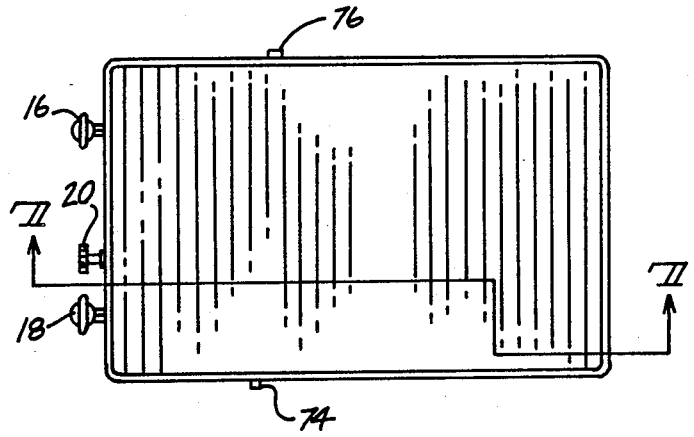
FIG. 2 is a top plan view of the dispenser.

FIG. 2 is a top view of the dispenser with the cushioned lid 14 closed.

Figure 3:
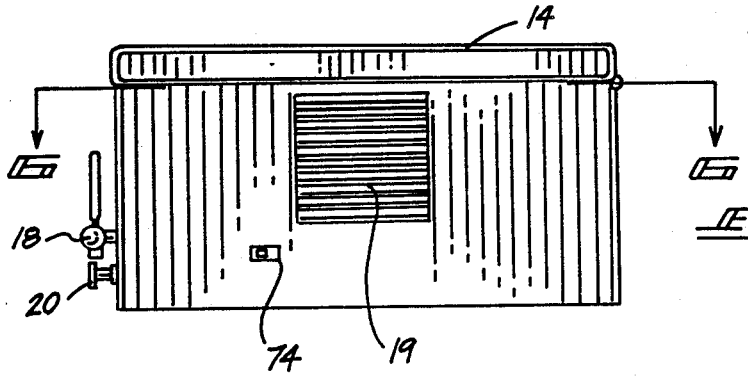
FIG. 3 is a side elevation of the dispenser.
Figure 6:
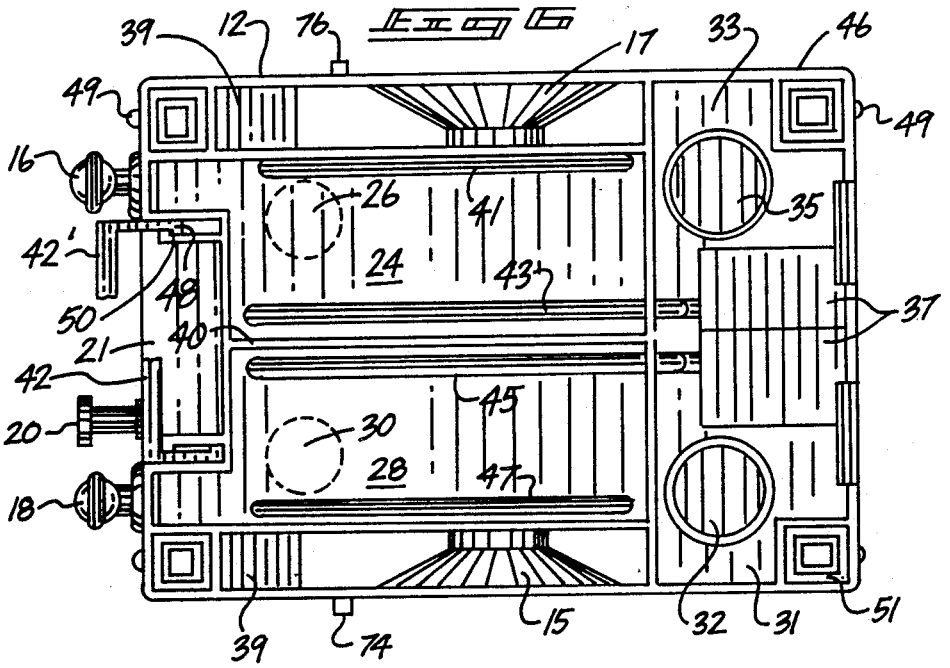
FIG. 6 is a top sectional view taken on line 6—6 of FIG. 3.

FIG. 3 is a side view of the dispenser showing openings 19 for the speaker 15 shown in FIG. 6. Similar openings are provided on the opposite side of the dispenser for speaker 17.

Figure 4:
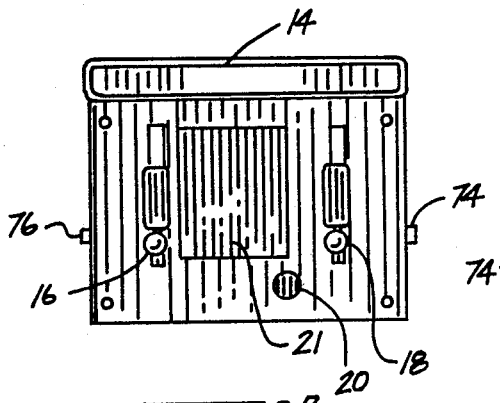
FIG. 4 is a front elevation of the dispenser.

FIG. 4, a front view of the dispenser, shows handle 42 slid to an upper position.

FIG. 5 is a rear view of the dispenser showing hinge 13 joining lid 14 to the back of housing 12. Dispenser socket 29 is configured for engagement with one end of plug 34, for tapping the electrical system of a vehicle through a conventional vehicle cigarette lighter socket.

FIG. 6, a top sectional view of the dispenser, clearly illustrates the heating and cooling mechanisms of the tanks 24 and 28. Heating tubes 41 and 47 heat tanks 24 and 28, respectively. The heating tubes are each connected, independently, to their respective, adjacent, electrical heating elements 39. Cooling tubes 43 and 45 cool tanks 24 and 28, respectively. The cooling tubes are independently connected to their respective, adjacent, thermoelectric cooling elements and batteries 37. Thermoelectric cooling elements and batteries 37 may be of conventional construction, as shown in U.S. Pat. No. 4,384,512, the disclosure of which is hereby incorporated by reference.

Hand pumps 32 and 35 independently pressurize reservoirs 31 and 33, which, in turn, charge liquids in tanks 28 and 24 with pressure against beverage taps 18 and 16, respectively.

Handle 42 is shown alternatively in the retracted and extended positions 42', the latter resulting from handle flange 48 engaging housing flange 50 on two sides. Within the recess 44 (FIG. 1) is shown radio 21, suitably plugged into the dispenser's independent power source through outlet 75 shown in FIG. 7. The radio is connected for driving speakers 15 and 17, when received within the recess 44, as shown in FIG. 12.

Legs 51 are shown in FIGS. 6 and 7. Each of the four legs 51 can slide in and out of leg wells 46. Retaining pin 49 is biased outwardly by spring 55 and is designed to engage housing hole 57 when in the leg is in the extended position outside of leg well 46 and housing hole 59 when the leg is in the retracted position within leg well 46. Guide runner 70 slides along track 71 and limits leg extension in a manner such that the top of leg 51 will not slip out of leg well 46.

FIGS. 8–11 illustrate the mounting skirt. Particularly, they show gripping projections 63 which are adapted to grip the carpet around the transmission hump, thus more securely mounting the dispenser within a vehicle.

Figure 12:
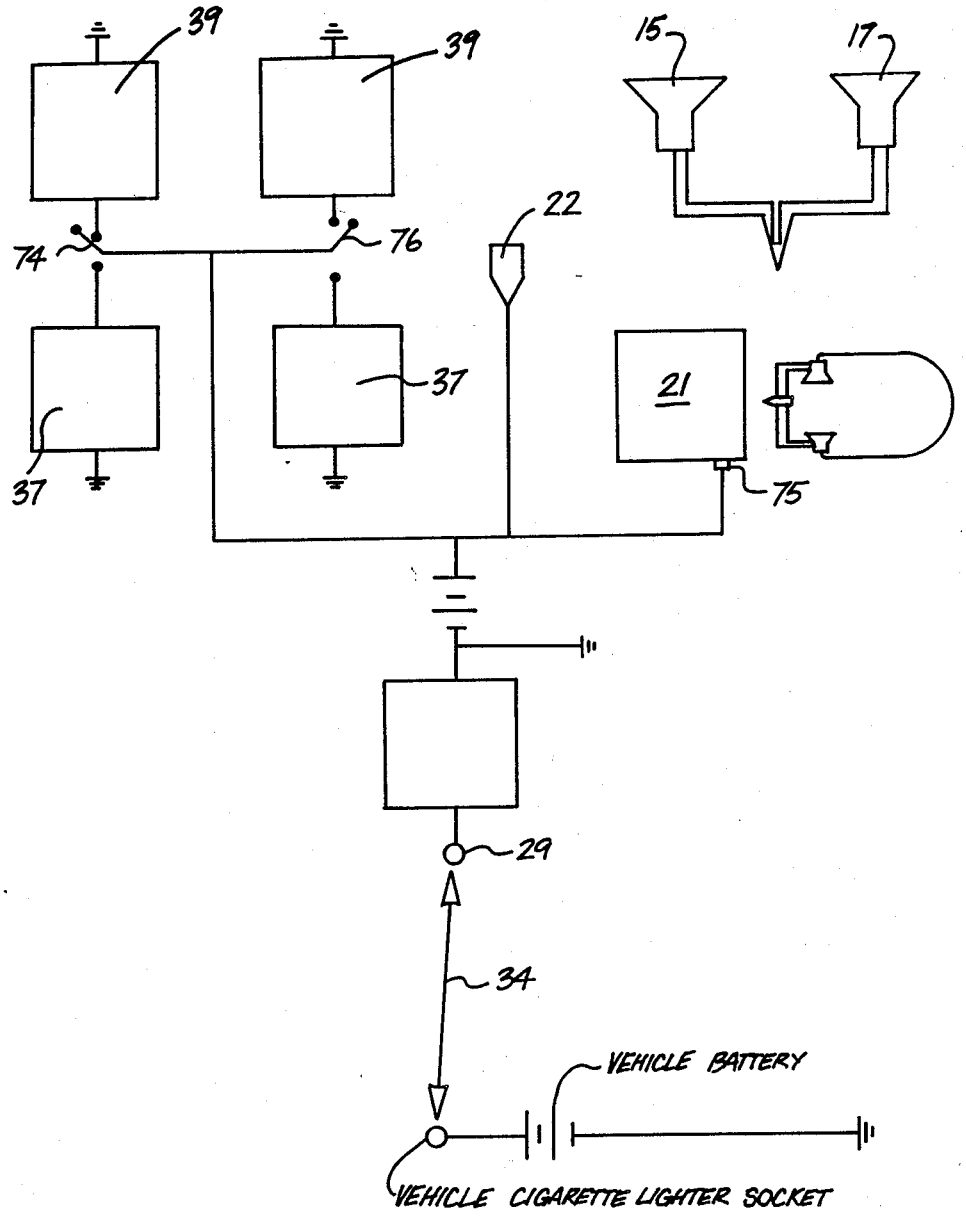
FIG. 12 is a schematic diagram illustrating the electrical components of the dispenser.

FIG. 12 shows a schematic diagram of the wiring. A power source, such as a car battery, may be connected to rechargeable battery 37 using plug 34 plugged into a standard automobile socket at one end and dispenser socket 29 at the other end. Wiring then exists connecting rechargeable battery 37, which includes a switching controller, to cigarette lighter socket 22, radio plug 75, and switches 74 and 76. Switches 74 and 76 may be switched to supply power to the heating elements 47 and 41, respectively, or to the cooling elements 45 and 43, respectively, or to an off position.

Note that the wiring permits fully independent storage temperatures in the separate tanks so that, for example, either one may be heated while the other is cooled. Note also that the radio is fully separable from the circuitry so that it may either be played apart from the dispenser, or attached within housing recess 44, and utilized either with earphones 80, or connected to speakers 15 and 17.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable beverage dispenser, comprising:

a housing having a front wall, back wall, and side walls;

a pair of adjacent tanks in said housing divided by an insulated partition;

each of said tanks having a fill opening and cap means for closing said fill opening;

each of said tanks having a dispensing outlet with means for independently regulating flow of liquids from said tanks;

heating tubes attached to electrical heating elements for heating liquids in said tanks;

cooling tubes attached to thermoelectric cooling elements for cooling liquids in said tanks;

said heating and cooling elements independently connected to a rechargeable battery;

each pair of said heating and cooling elements being actuated by a three position switch;

connecting wires with automobile cigarette lighter plug members at each end for connecting said rechargeable battery to a conventional automobile cigarette lighter plug;

independent means for pressurizing each of said tanks, each independent means for pressurizing comprising a hand pump acting upon a pressure reservoir;

said adjacent tanks having parallel sides and common, generally parallel front and back walls and common, parallel top and bottom walls;

said outlets and means for regulating flow of liquids on said front wall adjacent to respective tanks;

said front wall having a recessed area and handle means slidably attached on sides of said recessed area such that said handle means traverses said recessed area with room between said handle means and said recessed area of said front wall, said room between said handle means and said front wall having a width and depth sufficient for the profile of a small portable radio;

radio speakers mounted adjacent outside side walls of said tanks; and means for connecting a radio to said battery and to said speakers.

2. The portable beverage dispenser of claim 1, further comprising a rigid cover having a generally rectangular shape extending the length and width of said housing, said cover hinged at the top of said housing back wall, said cover formed from a padded material.

3. The portable beverage dispenser of claim 2, further comprising a leg well extending the height of said housing located at each end of each housing side wall, said leg well containing guide tracks, legs attached to said guide tracks at one end by guide runners, retaining pins attached to said legs at the same end but on opposite sides from said guide runner, housing body holes near the top and bottom of said back and front housing walls in line with said retaining pins such that said pins on said legs can retractably protrude from said housing holes.

4. The portable beverage dispenser of claim 3, further comprising a mounting skirt comprising a top plate and hinged side plates, said side plates spring biased toward the bottom of said top plate, said top plate having two eye holes, skirt mounting pegs attached to said housing bottom wall located the same distance from each other as the distance between said eye holes on said top plate of said mounting skirt, said skirt mounting pegs and mounting skirt eye holes located with respect to each other such that their engagement will place said housing bottom flush with said top plate of said mounting skirt with said side plates parallel to said housing sides, said side plates having small, sharp projections.

5. A portable beverage dispenser, comprising:

a pair of adjacent tanks divided by an insulated partition;

each of said tanks having a fill opening and cap means for closing said fill opening;

each of said tanks having a dispensing outlet with means for independently regulating flow of liquids from said tanks;

heating tubes attached to electrical heating elements for heating liquids in said tanks;

cooling tubes attached to thermoelectric cooling elements for cooling liquids in said tanks;

said heating and cooling elements independently connected to a rechargeable battery;

said adjacent tanks having parallel sides and common, generally parallel front and back walls and common, parallel top and bottom walls;

said front wall having a recessed area and handle means slidably attached on sides of said recessed area such that said handle means traverses said recessed area with room between said handle means and said recessed area of said front wall, said room between said handle means and said front wall having a width and depth sufficient for the profile of a small portable radio;

radio speakers mounted adjacent outside side walls of said tanks; and means for connecting a radio to said battery and to said speakers.

6. A portable beverage dispenser, comprising: a pair of adjacent plastic tanks divided by an insulated partition, each tank having a means for heating and a means for cooling the contents of said tanks, each tank having openings and means for closing said openings, each tank having outlets with means for independently regulating flow of liquids from said tanks, said independent flow regulating means consisting of dispensing taps, each tank having independent means for pressurizing said tanks, each independent means for pressurizing comprising a hand pump acting upon a pressure reservoir, said means for heating comprising of heating tubes attached to electrical heating elements, said means for cooling comprising cooling tubes attached to thermoelectric cooling elements, said heating and cooling elements independently connected to a power source, said power source comprising a rechargeable battery, a connecting wire with automobile cigarette lighter plug members at each end for connecting said rechargeable battery with a conventional automobile cigarette lighter plug, said adjacent tanks having parallel sides and common, generally parallel front and back walls and common, parallel top and bottom walls, said outlets and means for regulating flow of liquids on the front wall adjacent to their respective tanks, said front wall containing a recessed area and handle means slidably attached on the sides of the recessed area such that the handle means traverses the recessed area with room between the handle means and the recessed area of the front wall, said room between handle means and front wall having a width and depth sufficient for the profile of a small portable radio, radio speakers adjacent the outside side walls of the tanks, means for connecting a radio to the power source and to the speakers, housing side walls separated from the tanks' outside side walls by the width of the speakers, said side walls having three position switches which actuate said heating and cooling elements operating within said tanks, a housing rear wall separated from the tanks' back wall by a width defining the pressure reservoirs, said pressure reservoirs surrounding three sides of the thermoelectric cooling elements and battery, said battery having a socket for engaging a standard cigarette lighter plug, said socket extending through said housing rear wall, a housing bottom wall separated from the tank bottom wall by more than the diameter of said lighter plug, a rigid cover having a generally rectangular shape extending the length and breadth of the housing, said cover hinged at the top of the housing rear wall, said cover comprising of padded material, a leg well extending the height of the housing located at each end of each housing side wall, said leg well containing guide tracks, legs attached to said guide tracks at one end by guide runners, retaining pins attached to said legs at the same end but on opposite sides from the guide runner, housing body holes near the top and bottom of the back and front housing walls in line with the retaining pins such that said pins on said legs can retractably protrude from said housing holes, a mounting skirt comprising a top plate and hinged side plates, said side plates spring biased toward the bottom of the top plate, said top plate having two eye holes, skirt mounting pegs attached to the housing bottom wall located the same distance from each other as the distance between the eye holes on the top plate of the mounting skirt, said skirt mounting pegs and mounting skirt eye holes located with respect to each other such that their engagement will place the housing bottom flush with the top plate of the mounting skirt with the side plates parallel to the housing sides, said side plates having small, sharp projections.

* * * * *